US007797882B2

(12) United States Patent
Lubaway

(10) Patent No.: US 7,797,882 B2
(45) Date of Patent: Sep. 21, 2010

(54) WINDOW POSITIONING APPARATUS

(75) Inventor: Richard Lubaway, Sterling Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 379 days.

(21) Appl. No.: 10/709,557

(22) Filed: May 13, 2004

(65) Prior Publication Data

US 2004/0226223 A1 Nov. 18, 2004

Related U.S. Application Data

(60) Provisional application No. 60/470,269, filed on May 14, 2003.

(51) Int. Cl.
*E05F 11/48* (2006.01)

(52) U.S. Cl. ..... 49/352; 49/348; 49/349

(58) Field of Classification Search ..... 49/348, 49/349, 352, 501, 502

See application file for complete search history.

(56) References Cited

U.S. PATENT DOCUMENTS

| | | | | | |
|---|---|---|---|---|---|
| 1,990,624 | A | * | 2/1935 | Waddey | 49/280 |
| 2,059,027 | A | | 10/1936 | Potter | |
| 2,229,273 | A | | 1/1941 | Brockway | |
| 2,365,742 | A | | 12/1944 | Brooks | |
| 2,665,904 | A | | 1/1954 | Lehmann | |
| 2,820,628 | A | * | 1/1958 | Oishei et al. | 49/72 |
| 3,143,340 | A | * | 8/1964 | Maslonka | 74/89.36 |
| 3,209,412 | A | * | 10/1965 | Golde | 49/360 |
| 3,219,335 | A | * | 11/1965 | Burridge | 49/360 |
| 3,640,022 | A | * | 2/1972 | Kouth et al. | 49/420 |
| 3,736,702 | A | * | 6/1973 | Pickles | 49/362 |
| 3,967,511 | A | | 7/1976 | Breitschwerdt | |
| 4,257,192 | A | | 3/1981 | Bartholomew | |
| 4,400,913 | A | | 8/1983 | Krantz et al. | |
| 4,575,967 | A | | 3/1986 | Bickerstaff | |
| 4,613,073 | A | * | 9/1986 | Christ et al. | 237/12.3 R |
| 5,345,719 | A | * | 9/1994 | Karwande | 49/502 |
| 5,987,820 | A | | 11/1999 | Shibanushi | |
| 6,021,691 | A | | 2/2000 | Wilkerson, Jr. | |
| 6,088,965 | A | | 7/2000 | Fukumoto et al. | |
| 6,125,588 | A | | 10/2000 | Schultz | |
| 6,170,197 | B1 | | 1/2001 | Tyves et al. | |
| 6,216,394 | B1 | * | 4/2001 | Fenelon | 49/349 |
| 6,427,385 | B1 | | 8/2002 | Fin | |
| 6,464,287 | B2 | | 10/2002 | Rogers, Jr. et al. | |
| 6,539,670 | B2 | | 4/2003 | Haag et al. | |
| 6,546,674 | B1 | | 4/2003 | Emerling et al. | |
| 6,631,586 | B1 | * | 10/2003 | Nakagomi et al. | 49/349 |
| 2003/0085589 | A1 | | 5/2003 | Oberheide | |

* cited by examiner

*Primary Examiner*—Jerry Redman
(74) *Attorney, Agent, or Firm*—Raymond L. Coppiellie; Brooks Kushman P.C.

(57) ABSTRACT

An apparatus for positioning a vehicle window. The apparatus includes a lift mechanism configured to move the window between a raised position and a lowered position. A strut may bias the window toward the raised position.

19 Claims, 3 Drawing Sheets

WINDOW POSITIONING APPARATUS

CROSS REFERENCE TO RELATED APPLICATIONS

This application claims the benefit of U.S. provisional application Ser. No. 60/470,269 filed May 14, 2003.

BACKGROUND OF INVENTION

1. Field of the Invention

The present invention relates to an apparatus for positioning a vehicle window.

2. Background Art

Window lift mechanisms are used to raise and lower window panels relative to a vehicle door cavity. Examples of such window lift mechanisms are disclosed in U.S. Pat. Nos. 6,427,385 and 6,546,674.

SUMMARY OF INVENTION

According to one aspect of the present invention, an apparatus for positioning a window in a vehicle is provided. The apparatus includes a lift mechanism and a strut. The lift mechanism is disposed on a mounting surface and configured to move the window between a raised position and a lowered position. The strut has a first end disposed on the mounting surface and a second end adapted to engage the window. The strut biases the window toward the raised position.

The lift mechanism may include a guide track, a carriage, and a link. The guide track is configured to be attached to the mounting surface. The carriage is movably coupled to the guide track. The link is connected to the carriage at a lower end and connected to the window at an upper end.

A window bracket may be connected to the window. The link and the strut may be pivotally attached to the window bracket.

The carriage may include a roller for engaging the guide track. The guide track may have a plurality of external surfaces. The carriage may have a plurality of rollers. The plurality of rollers may be configured to engage the external surfaces of the guide track.

The window may include first and second glass layers. The first layer may include a projection that extends past the second layer. The projection may include a narrow portion adapted to slide within a channel.

According to another aspect of the invention, an apparatus for positioning a window disposed in a closure of a vehicle is provided. The closure includes a channel for receiving a portion of the window and a mounting surface. The apparatus includes a guide track, a carriage, a link, and an actuator. The guide track is configured to be attached to the mounting surface. The carriage has a plurality of rollers adapted to engage the guide track. The link is connected to the carriage at a first end and connected to a first window bracket at a second end. The actuator moves the carriage along the guide track. The plurality of rollers roll along the guide track to move the window between a raised position and a lowered position.

The apparatus may include a first strut attached to the first window bracket and a second strut attached to a second window bracket.

The window may include a plurality of layers. The window may also include an edge treatment disposed proximate to the edge of a second layer that is configured to inhibit moisture intrusion between the plurality of layers.

According to another aspect of the invention, an apparatus for raising and lowering a window disposed in a door of a vehicle is provided. The apparatus includes a guide track, a carriage, a link, a window regulator assembly, and a strut. The guide track is configured to be attached to a door body. The carriage includes a plurality of rollers configured to engage the guide track. The link is attached to the carriage at a first end and adapted to engage the window at a second end. The link may be pivotally attached to the carriage by a pin. The window regulator assembly is adapted to move the carriage between a raised position and a lowered position. The strut is attached to the door body at a first end and adapted to engage the window at a second end. The strut is configured to bias the window toward the raised position.

The apparatus may include a window release assembly. The window release assembly may include a release cable attached to the pin. Application of sufficient force on the release cable may disengage the pin and allow the window to move independent of the carriage. A release cable guide through which the release cable passes may be disposed proximate the strut.

DETAILED DESCRIPTION

Figure 1:
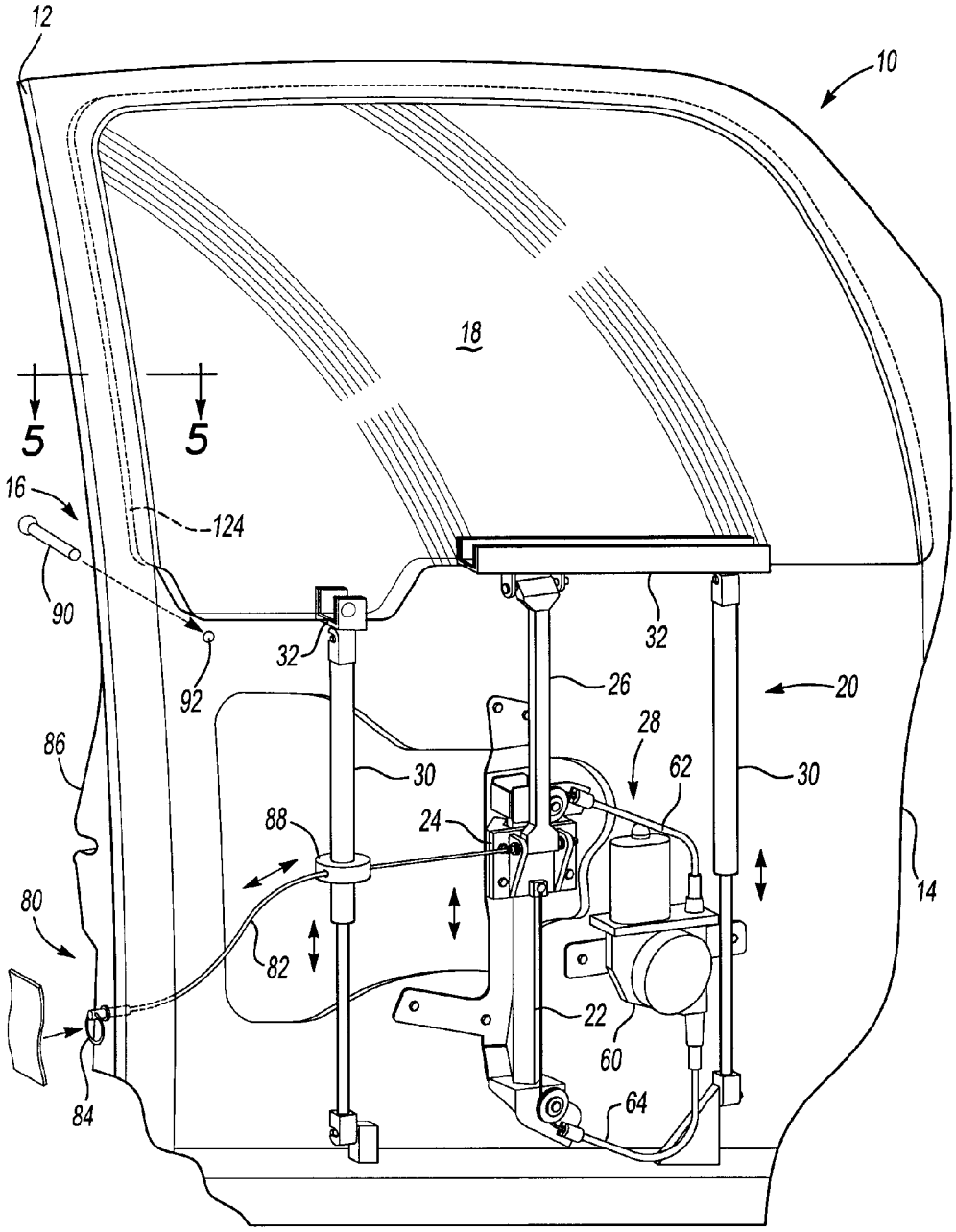
FIG. 1 is a cutaway perspective view of a vehicle closure including a window positioning apparatus.

Referring to FIG. 1, a closure 10 for a vehicle is shown. A vehicle closure is an assembly that is movably attached to a vehicle body and is configured to cover one or more body openings when disposed in a closed position. Vehicle closures include doors, tailgates, and other components. In the embodiment shown in FIG. 1, the closure 10 is configured as a vehicle door.

The closure 10 includes an outer panel 12 and an inner panel 14. The outer panel 12 may form an exterior vehicle surface. The outer panel 12 may have any have any suitable configuration and may be made of any suitable material, such as fiberglass, a polymeric material, or a metal like steel or aluminum.

The inner panel 14 may help provide structural support for the closure 10. The inner panel 14 may be positioned between the outer panel 12 and an interior trim panel (not shown). The inner panel 14 may have any suitable configuration and may be made of any suitable material.

A window positioning apparatus 16 may be positioned in the closure 10. The window positioning apparatus 16 includes a window 18 and a lift mechanism 20. The lift mechanism 20 is configured to move the window 18 between a raised position as shown in FIG. 1 and a lowered position. The window positioning apparatus 16 may be connected to the outer and/or inner panels 12,14. In the embodiment shown, the window positioning apparatus 16 is attached to the inner panel 14 along a mounting surface.

The window 18 may have any suitable configuration and may be made from any suitable material(s), such as glass and/or polycarbonate. Moreover, the window 18 may have a ballistic or "bulletproof" construction as discussed in further detail below.

Figure 2:
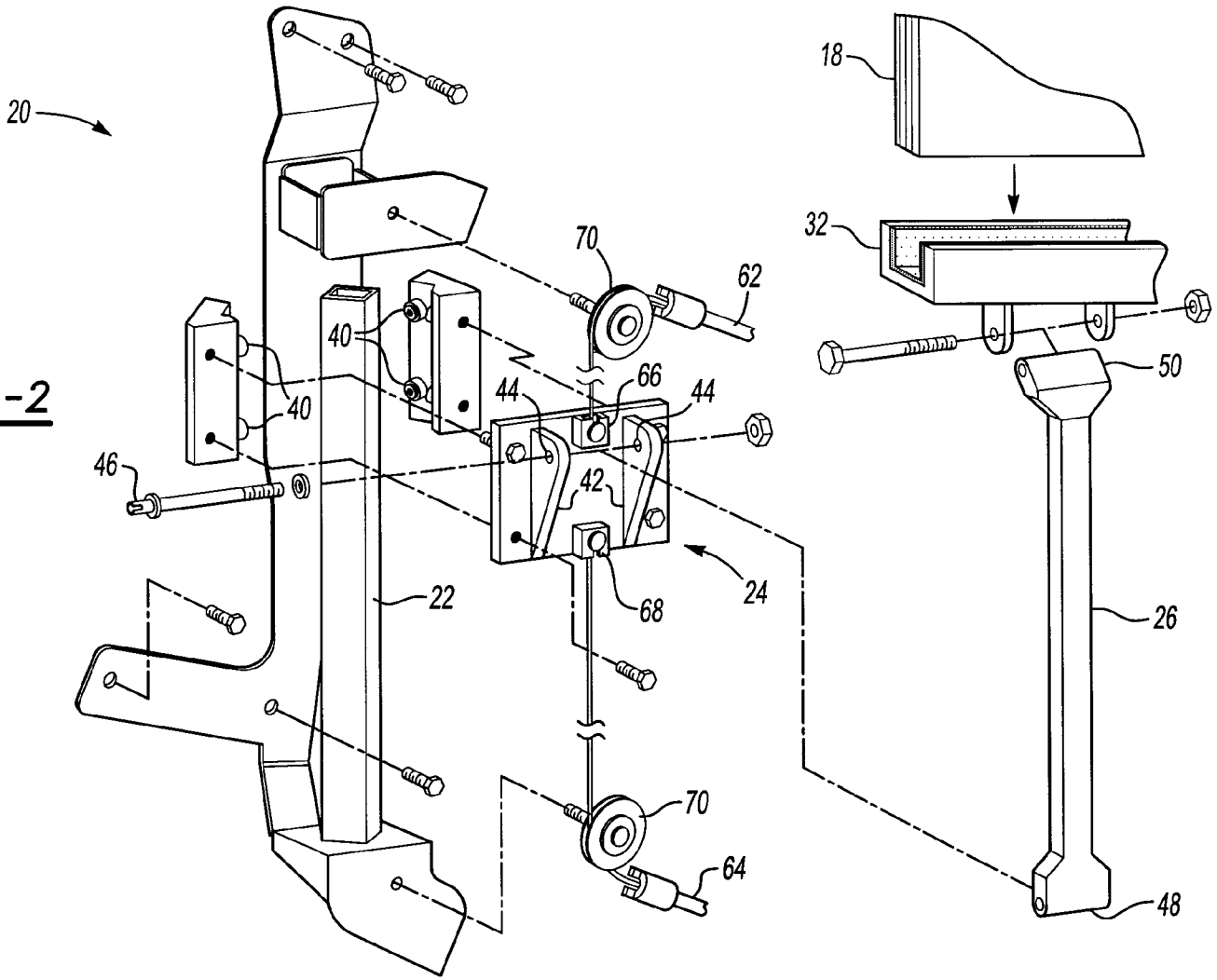
FIG. 2 is an exploded perspective view of a portion of a lift mechanism.

Referring to FIGS. 1 and 2, the lift mechanism 20 includes a guide track 22, a carriage 24, a link 26, and an actuator or window regulator 28. In addition, the lift mechanism 20 may include a strut 30 and a window bracket 32.

The guide track 22 is disposed on the closure 10 and may be oriented substantially parallel to the direction of window travel. In the embodiment shown, the guide track 22 has a tubular configuration and a square cross-section. However, the guide track 22 may have any suitable construction, number of sides, or shape. In addition, the guide track 22 may be made of any suitable material, such as a polymeric material or a metal like stainless steel.

Figure 3:
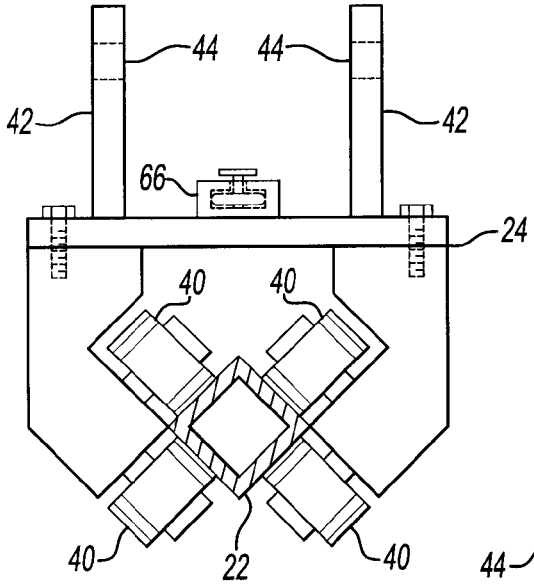
FIG. 3 is a perspective view of a carriage.
Figure 4:
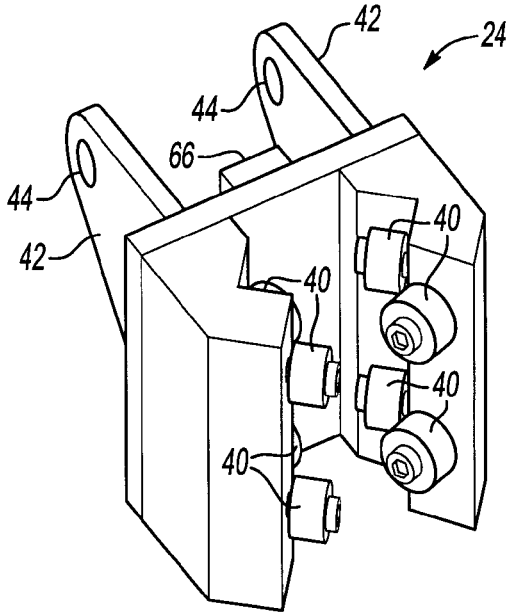
FIG. 4 is a section view of the vehicle closure along section 4-4.

Referring to FIGS. 2 and 3, the carriage 24 is shown in more detail. The carriage 24 is adapted to engage a guide track 22. The carriage 24 includes one or more rollers 40 and may include one or more flanges 42.

The rollers 40 are rotatably disposed on the carriage 24 and are adapted to engage the guide track 22. In the embodiment shown, the carriage 24 includes eight rollers. However, the carriage 24 may be configured with a greater or lesser number of rollers. The rollers 40 may be made of any suitable material, such as brass or nylon.

The rollers 40 may have any suitable positioning or orientation. For example, one or more rollers 40 may engage a surface of the guide track 22. In the embodiment shown, the rollers 40 are organized in four pairs such that each pair of rollers contacts a different surface of the guide track 22. The rollers 40 may be positioned in a staggered or offset configuration along the length of the guide track 22.

The flange 42 may be positioned on the carriage 24 on a side opposite the rollers 40. In the embodiment shown, two flanges 42 are employed. Each flange 42 may include an aperture 44. The aperture 44 is configured to receive a carriage pin 46 that pivotally connects the link 26 to the carriage 24. Optionally, a bushing (not shown) may be inserted in the aperture 44 to inhibit wear.

The link 26 includes a first end 48 and a second end 50. The first end 48 is pivotally attached to the carriage 24 with the carriage pin 46 as previously described. Similarly, the second end 50 is pivotally attached to the window bracket 32 with a bracket pin 52. The link 26 may have any suitable configuration and may be made of any suitable material, such as metal or a polymeric material.

The window regulator 28 is mounted on the closure 10. In the embodiment shown, the window regulator 28 is attached to the inner panel 14. The window regulator 28 includes a motor and drum assembly 60, a first cable 62, and a second cable 64. The first and second cables 62,64 are connected to the motor and drum assembly 60 at a first end and connected to the carriage 24 at a second end. More specifically, the first and second cables 62,64 are connected to first and second attachment blocks, 66,68, respectively. Optionally, the first and second cables 62,64 may be guided by pulleys 70.

The motor and drum assembly 60 is configured to wind or pull the first cable 62 when the drum rotates in a first direction. Likewise, the motor and drum assembly 60 winds or pulls the second cable 64 when the drum rotates in the opposite direction. The carriage 24 and window 18 move toward a raised position when sufficient force is exerted on the first cable 62. Likewise, the carriage 24 and window 18 move toward a lowered position when sufficient force is exerted on the second cable 64.

One or more struts 30 may be employed to help move the window 18. More specifically, the strut 30 counterbalances the weight of the window 18 and is configured to bias the window 18 toward the raised position. The strut 30 permits a conventional window regulator to be used to actuate heavy windows, such as ballistic glass panels. Moreover, the strut 30 helps reduce the time needed to close the window 18. Reduced closing time is desirable in high security vehicles, such as armored cars or limousines, to rapidly position the window in the protective raised position. Any suitable strut may be used, such as a Lift-O-Mat® gas-filled strut manufactured by Stabilus GmbH.

In the embodiment shown, two struts 30 are employed. The struts 30 are pivotally attached to the inner panel 14 at the lower ends and pivotally connected to window brackets 32 at the upper ends. Optionally, the struts 30 may be attached to a common window bracket.

The window bracket 32 is configured to receive the window 18. The window bracket 32 may have any suitable shape, such as a U-shaped cross-section. The window bracket 32 may be attached to the window 18 with an adhesive, such as Plexus™ EP series adhesive made by Illinois Tool Works. A ball stud may be disposed on the window bracket 32 to engage a strut 30. Likewise, a flange may be disposed on the window bracket 32 to receive the link 26.

The window positioning apparatus 16 may also include a manual release system 80. The manual release system 80 includes a release cable 82 having a pull ring 84. The release cable 82 is attached at a distal end to the carriage pin 46. Force is transmitted through the release cable 82 to disengage the carriage pin 46 when the pull ring 84 is pulled. The carriage 24 and the link 26 are decoupled when the carriage pin 46 is disengaged. Decoupling of the carriage 24 and the link 26 allows the window 18 to be manually positioned. More specifically, the window 18 may be grasped and pulled upward or pushed downward when the carriage pin 46 is removed. Manual window positioning is desirable in the event of a mechanical or electrical failure in the vehicle.

The pull ring 84 may be disposed in any accessible location. In the embodiment shown, the pull ring 84 is positioned along an end surface 86 of the closure 10. Optionally, the pull ring 84 may be concealed by a cover or layer of tape.

The manual release system 80 may include a cable guide 88. The cable guide 88 may have any suitable configuration and may be made of any suitable material, such as nylon. In the embodiment shown, the cable guide 88 is disposed on a strut 30. The release cable 82 is routed through a through hole to inhibit rattling, tangling, and/or binding.

A securing pin 90 may be used to inhibit window movement. The securing pin 90 is inserted through an aperture 92 in the closure 10. The aperture 92 may be disposed in any suitable location, such as in an interior trim panel. In the embodiment shown, the aperture 92 is configured to allow the securing pin 90 to be inserted under a raised window to inhibit downward movement toward the lowered position. Manual release and securing of a window is desirable in high security vehicles to permit a malfunctioning window to be raised and secured to better protect vehicle occupants.

The window positioning apparatus 16 of the present invention may be desirable for use with "heavy" windows, such as a ballistic glass. Ballistic glass may include a plurality of layers that make it much heavier than a conventional single-ply window. For example, a single-ply door window may weigh between 5 to 10 pounds, while a 40 mm thick ballistic window may weigh in excess of 60 pounds.

Figure 5:
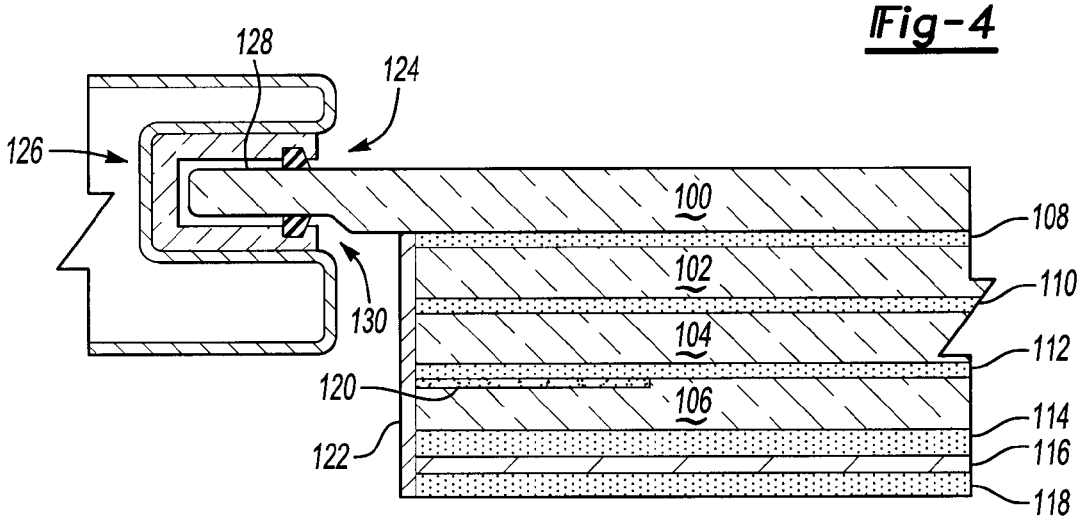
FIG. 5 is a section view of an exemplary window.

Referring to FIG. 5, one embodiment of a ballistic or "bulletproof" window is shown. The window 18 includes a plurality of layers. The layers may have any suitable configuration and may be made of any suitable material, such as glass or polycarbonate. In the embodiment shown, there are four glass layers 100,102,104,106 and four polycarbonate layers 108,110,112,114 configured in an alternating arrangement. Any number, combination, or arrangement of layers may be employed. In addition, the window 18 may include two additional inner layers 116,118 made of polyurethane and polycarbonate, respectively.

A black band or tint layer 120 may be disposed on or within one or more of the layers. In the embodiment shown, the tint layer 120 is disposed between the third polycarbonate layer 112 and the fourth glass layer 106. The tint layer 120, which may be a ceramic paint, may be disposed in any suitable location, such as near the perimeter of the window 18.

An edge treatment 122 may be disposed around the window perimeter. The edge treatment 122 helps seal the window 18 to inhibit contamination and/or moisture intrusion between the layers 100-114. The edge treatment 122 may be made of any suitable material, such as urethane, that is compatible with the physical and chemical properties of the layers 100-114.

In one embodiment, the outside or first glass layer 100 includes a projection 124. The projection 124 extends from the window 18 along a portion the window perimeter. The projection 124 is adapted to engage the window channel 126 of the closure 10.

The projection 124 may include a narrow portion 128. The narrow portion 128 is desirable when the thickness of the projection layer exceeds the width of the window channel 126. The narrow portion 128 allows a "thick" window to be installed without modification to the original window channel 126.

The narrow portion 128 may be made in any suitable manner, such as by grinding one or more surfaces of the layer having the projection 124. A transition portion 130 to the narrow portion 128 may be curved or contoured to improve stress distribution.

A method of forming a multi-layer window will now be described. First, the glass and polycarbonate layers are formed with the appropriate curvature and dimensions. This step may include forming the narrow portion 128. For example, one or more layers may be ground with an appropriate tool, such as a carbide or diamond cutter, to create the narrow portion 128. Second, the tint layer 120 is applied to one or more of the material layers as needed. Third, the layers are assembled and laminated or bonded together, such as with an autoclave. Finally, the edge treatment 122 is applied to the appropriate layers to seal the window perimeter.

While the best mode for carrying out the invention has been described in detail, those familiar with the art to which this invention relates will recognize various alternative designs and embodiments for practicing the invention as defined by the following claims.

The invention claimed is:

1. An apparatus for positioning a window, the apparatus comprising:

a lift mechanism configured to move between a raised position and a lowered position and having a guide track, a carriage movably disposed on the guide track, and a link pivotally connected to the carriage with a pin and pivotally connected to a first window bracket at an upper end;

first and second struts attached to first and second window brackets, respectively, that help bias the lift mechanism toward the raised position; and an actuator that actuates the lift mechanism with first and second cables that extend between the actuator and the carriage.

2. The apparatus of claim 1, wherein the link and the strut are pivotally connected to the first window bracket.

3. The apparatus of claim 1 wherein the carriage further has a roller for engaging the guide track.

4. The apparatus of claim 1 wherein the guide track has a plurality of external surfaces and the carriage has a plurality of rollers, the plurality of rollers configured such that at least one roller engages each external surface of the guide track.

5. The apparatus of claim 3 wherein the carriage further has first and second sides, the roller being disposed proximate the first side and the link being disposed proximate the second side.

6. The apparatus of claim 1 wherein the actuator is a motor.

7. The apparatus of claim 1 further comprising a window release assembly having a release cable.

8. An apparatus for positioning a window, the apparatus comprising:

a guide track;

a carriage having a plurality of rollers adapted to engage the guide track and a flange;

a link pivotally connected to the flange with a carriage pin at a first end and pivotally connected to a first window bracket at a second end;

an actuator for moving the carriage along the guide track;

first and second cables that extend between the actuator and the carriage; and a first strut attached to the first window bracket and a second strut attached to a second window bracket;

wherein the plurality of rollers roll along the guide track to move between a raised position and a lowered position.

9. The apparatus of claim 8 wherein the first strut is pivotally attached to the first window bracket.

10. The apparatus of claim 8 wherein the guide track has a plurality of external surfaces and the carriage has a plurality of rollers, the plurality of rollers configured such that at least one roller engages each external surface of the guide track.

11. The apparatus of claim 10 wherein multiple rollers engage each side of the guide track.

12. The apparatus of claim 8 wherein the carriage includes first and second flanges that pivotally receives the link.

13. The apparatus of claim 8 further comprising a window release assembly having a release cable.

14. An apparatus for raising and lowering a window disposed in a door of a vehicle, the apparatus comprising:

a guide track;

a carriage including a plurality of rollers, the rollers being configured to engage the guide track;

a link pivotally attached to the carriage at a first end with a pin and adapted to engage the window at a second end;

a window regulator assembly adapted to move the carriage between a raised position and a lowered position; and a window release assembly having a release cable attached at an end to the pin, wherein application of sufficient force on the release cable disengages the pin and allows movement of the link independent of the carriage.

15. The apparatus of claim 14 wherein the plurality of rollers are configured in pairs such that pairs of rollers are disposed on opposing surfaces of the guide track.

16. The apparatus of claim 14 wherein the link is pivotally attached to the carriage by the pin.

17. The apparatus of claim 14 further comprising a strut adapted to be attached to the door at a first end and adapted to engage the window at a second end, wherein the strut is configured to help bias the window regulator assembly toward the raised position.

18. The apparatus of claim 14 further comprising a release cable guide, the release cable guide disposed proximate the strut and including a passage through which the release cable passes.

19. The apparatus of claim 14 further comprising a locking pin.

* * * * *